US006436535B1

(12) United States Patent
Minamoto et al.

(10) Patent No.: US 6,436,535 B1
(45) Date of Patent: Aug. 20, 2002

(54) FIBER HAVING DURABLE HYDROPHILICITY AND FABRICS USING THE SAME

(75) Inventors: Koji Minamoto; Masahito Katsuya; Yukinori Kataoka, all of Shiga (JP)

(73) Assignee: Chisso Corporation, Osaka (JP)

( * ) Notice: Subject to any disclaimer, the term of this patent is extended or adjusted under 35 U.S.C. 154(b) by 217 days.

(21) Appl. No.: 09/614,209

(22) Filed: Jul. 11, 2000

(30) Foreign Application Priority Data

Jul. 16, 1999 (JP) ..... 11-202983
Mar. 31, 2000 (JP) ..... 2000-98350

(51) Int. Cl.[7] ..... D01F 6/00

(52) U.S. Cl. ..... 428/375; 428/378; 428/390; 442/181

(58) Field of Search ..... 428/387, 370, 428/375, 378, 390; 442/352, 353, 361, 364, 181

(56) References Cited

U.S. PATENT DOCUMENTS 5,654,086 A 8/1997 Nishijima et al. ..... 442/199
5,750,256 A * 5/1998 Ito et al. ..... 428/375
6,211,101 B1 * 4/2001 Tsutsui et al. ..... 428/118
6,274,237 B1 * 8/2001 Nakajima et al. ..... 428/370
6,303,220 B1 * 10/2001 Minamoto et al. ..... 428/364

FOREIGN PATENT DOCUMENTS

JP 402216265 A * 8/1990

* cited by examiner

*Primary Examiner*—N. Edwards
(74) *Attorney, Agent, or Firm*—McDermott, Will & Emery

(57) ABSTRACT

A fiber or fabric having durable hydrophilicity and excellent anti-staticity is produced by adhering specific amount of a fiber treating agent comprising the following components (A), (B), (C), (D) and (E) each at the following ratio onto the surface of thermoplastic resin fiber or fabric (A). 20 to 40% by weight polyglycerin fatty acid ester of specific structure, based on the total of (A) to (E);

(B). 5 to 20% by weight of polyoxyalkylene modified silicone of specific structure, based on the total of (A) to (E);

(C). 10 to 25% by weight of alkyl imidazolium alkyl sulfate of specific structure, based on the total of (A) to (E);

(D). 5 to 20% by weight of alkylene oxide adduct of alkanoylamide, based on the total of (A) to (E);

(E). 25 to 40% by weight of polyetherester of specific structure, based on the total (A) to (E).

5 Claims, No Drawings

FIBER HAVING DURABLE HYDROPHILICITY AND FABRICS USING THE SAME

TECHNICAL FIELD

The present invention relates to a fiber with permanent hydrophilic nature having anti-static properties and softness obtained by adhering a fiber treating agent of a specific composition onto the fiber comprising hydrophobic thermoplastic resin; and to fabrics using said fiber.

More particularly, the present invention relates to a fiber having durable hydrophilicity and relates to fabrics using said fiber which is mainly useful as a face of hygienic goods such as disposable diaper or sanitary napkin in contact with human skin; or as a wiping cloth for industrial and medical use.

BACKGROUND ART

The consumption of fabrics represented by nonwoven fabric is increasing worldwide; especially the ratio shared by nonwoven fabric made of polyolefin fiber and polyester fiber is increasing year by year due to the spreading of one way goods such as disposable diaper, sanitary napkin or a wiping cloth. In the market of one way goods, cost competitiveness and differentiation from the other products are especially demanded in view of the product's nature of only one time use.

Among the requirements to fiber and nonwoven fabric used for such products, regarded as important are antistaticity to produce nonwoven fabric at high speed and durable hydrophilicity to differentiate from the other products.

Following methods are generally known to impart antistaticity and durable hydrophilicity to highly hydrophobic polyolefin or polyester fibers:

1) adhering a fiber treating agent onto fibers
2) fiber using resin comprising hydrophilic polymers
3) introduction of hydrophilic group to the surface of fiber through sulfonation, plasma treatment or corona discharge treatment.

Method 1) is most generally applied for hydrophilic fibers used in one way products. For example, in JP-A-49166/97, a fiber imparted to durable hydrophilicity through adhering small amount of fiber treating agent onto the surface of a fiber, is proposed. However, the fiber treating agent disclosed here, can impart durable hydrophilicity to some extent but insufficient to meet the current market demand.

By method 2), sufficient durable hydrophilicity has not yet been achieved. Moreover, problem is its high cost for disposable article.

As to method 3), though good hydrophilicity is obtained just after the treatment to fiber as mentioned above, hydrophilicity deteriorates due to change of the introduced hydrophilic group on the surface of fiber with time.

Inventors of the present invention have made enthusiastic effort to solve the above mentioned problems. As the result, we have found that a fiber or fabrics having durable hydrophilicity together with good antistaticity can be obtained by adhering a fiber treating agent containing specific amount of the mixture made by mixing specific compounds to the specific composition to the surface of thermoplastic resin fiber or fabrics, and have achieved the present invention based on the above finding.

As apparent from the foregoing, the object of the present invention is to provide a thermoplastic resin fiber having durable hydrophilicity which has been the problem of prior art as mentioned above together with good antistaticity and to provide fabrics using the fiber.

SUMMARY OF THE INVENTION

The present invention also consists in:

(1) A fiber having durable hydrophilicity obtained by adhering a fiber treating agent comprising at least 60% by weight of a mixture consisting of the following components (A), (B), (C), (D) and (E) each at the following composition to fiber of thermoplastic resin at the level of 0.1 to 1.0% by weight based on fiber weight.

(A) 20 to 40% by weight, based on the total of (A) to (E), of polyglycerin fatty acid ester expressed by the following Formula A, Formula A:

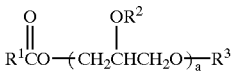

wherein $R^1$ represents alkyl or alkenyl group having 7 to 21 carbon atoms; $R^2$ and $R^3$ each represent H, alkanoyl group having 8 to 22 carbon atoms or alkenoyl group; "a" indicates an integer of 5 to 15.

(B) 5 to 20% by weight, based on the total of (A) to (E), of polyoxyalkylene modified silicone expressed by the following Formula B, Formula B:

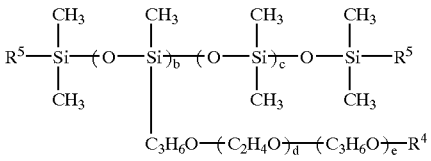

wherein $R^4$ represents H or alkyl group having 1 to 12 carbon atoms; $R^5$ represents $CH_3$ or $C_3H_6O(C_2H_4O)_d(C_3H_6O)_eR_4$; "b" indicates an integer of 3 to 15; "c" indicates an integer of 10 to 120; "d" indicates an integer of 5 to 100; "e" indicates an integer of 5 to 100; with the proviso that "d+e" is an integer equal to or less than 105.

(C) 10 to 25% by weight, based on the total of (A) to (E), of alkyl imidazolium alkyl sulfate expressed by the following Formula C, Formula C:

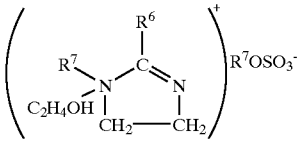

wherein $R^6$ represents alkyl group having 7 to 21 carbon atoms; $R^7$ represents methyl or ethyl group.

(D) 5 to 20% by weight, based on the total of (A) to (E), of alkylene oxide adduct of alkanoylamide expressed by the following Formula D, Formula D:

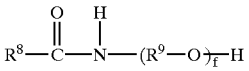

wherein $R^8$ represents alkyl group having 7 to 21 carbon atoms; $R^9$ represents alkylene unit having 2 to 4 carbon atoms; "f" indicates an integer of 5 to 30.

(E) 25 to 40% by weight, based on the total of (A) to (E), of polyetherester expressed by the following Formula E, Formula E:

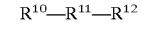

wherein $R^{10}$ represents moiety of aliphatic hydroxy compound having hydroxy value of 1 to 6; $R^{11}$ represents polyether-polyester block expressed by Formula F or Formula G; $R^{12}$ represents H, alkanoyl group having 2 to 18 carbon atoms or alkenoyl group having 16 to 22 carbon atoms.)

Formula F:

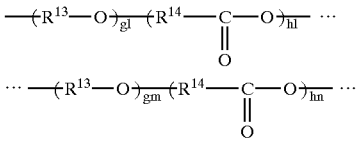

Formula G:

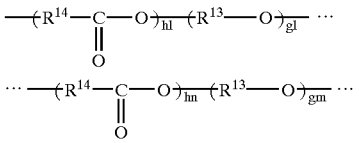

wherein Formula F and Formula G, $R^{13}$ represents alkylene unit having 2 to 4 carbon atoms; $R^{14}$ represents alkylene unit having 2 to 12 carbon atoms; "m" and "n" each indicates an integer equal to or larger than 1; "$g_1$" to "$g_m$" each indicates an integer provided that the sum $g=g_1+g_2+\ldots+g_m$ is 5 to 200; "$h_1$" to "$h_n$" each indicates an integer provided that the sum, $h=h_1+h_2++\ldots h_n$ is 5 to 200 and $g \geqq h$.

(2) A fiber having durable hydrophilicity described in item (1) above which is a conjugate fiber made by combining at least two kind of thermoplastic resins.

(3) A fiber having durable hydrophilicity described in either item (1) or (2) above in which at least one component of thermoplastic resins composing the fiber is polyolefin resin.

(4) A fiber having durable hydrophilicity described in either items (1) or (2), above in which at least one component of thermoplastic resins composing the fiber is polyester resin.

(5) A fabric comprising a fiber having durable hydrophilicity described i[008e] any one from item (1) to (4) above.

DETAILED DESCRIPTION OF PREFERRED EMBODIMENTS

The present invention will be described in detail as follows.

As for fibers comprising thermoplastic resin in the present invention, the fibers comprising thermoplastic resin such as polyolefins, polyesters or polyamides can be illustrated. However, in case of using for the face material and so on in the field of hygienic materials, fibers comprising hydrophobic thermoplastic resin such as polyolefin resins or polyester resins are preferable from the point of dry touch feeling.

Polyolefin resins mentioned here indicate ethylene homopolymer, propylene homopolymer, α-olefin copolymers of ethylene or propylene with other α-olefin etc., or mixture of more than one of these. As for α-olefin copolymers, binary or ternary copolymers comprising propylene as main component, copolymerized with ethylene, butene-1, 4-methyl pentene-1 etc. or mixture of one or more of these can be illustrated.

As for polyesters, polyethylene terephthalate, polybutylene terephthalate, poly(ethylene terephthalate-co-ethylene isophthalate), copolyetherester etc. or mixture of these can be illustrated.

Further, by use, a mixture of polyolefins with polyesters or polyamides can be suitably adopted.

When the fiber having durable hydrophilicity of the present invention is a conjugate fiber comprising two or more of thermoplastic resins, combination of thermoplastic resins to be used can be illustrated as polyethylene/polypropylene, polyethylene/α-olefin copolymer, α-olefin copolymer/polypropylene or polyethylene/polyester and so on. Further, by use, co-polyester or polyamide can be suitably used for the raw material of a fiber having durable hydrophilicity of the present invention.

To the raw material resin used for a fiber having durable hydrophilicity of the present invention, various additives such as pigments, anti-static agents, flame retardants or antibiotics etc. can be added as far as the expected effects of the present invention are not impaired. These additives can also be used by mixing with the raw material resins at the spinning stage. The shape of cross section of the fiber having durable hydrophilicity of the present invention is not especially limited to and can be any arbitrary shape such as circular or profiled.

Also in case of conjugate fiber, the type of conjugation can be any arbitrary type. For example, when the fiber is a conjugate fiber with circular cross-section, conjugation type of fiber can be any arbitrary one such as side-by-side, sheath-core or eccentric sheath-core. Further the shape of cross-section, either in single component fiber or in conjugate fiber, can be any arbitrary one and can be illustrated as oval shape, polygonal such as triangle to octagonal, T-shape, hollowed section or polyfoliate.

Although the single fiber size of the fiber having durable hydrophilicity of the present invention is not especially limited to, when used for hygienic materials which require softness and touch feeling, fibers of 22 dtex or less, preferably 11 dtex or less, further preferably 9 dtex or less are used.

As for the form of fiber, any form such as short fiber or filament, presence or absence of crimp is available and can be suitably adopted.

Then the individual components constituting the fiber treating agent used in the present invention will be described hereinafter.

Component (A) constituting the fiber treating agent is Polyglycerin fatty acid ester expressed by Formula A mentioned before which is an effective component for improvement of durable hydrophilicity.

As polyglycerin fatty acid ester used in the present invention, hydroxy groups in polyglycerin block may be partially or totally esterified but the degree of esterification is preferably in the range of 10 to 60%, more preferably in the range of 15 to 50%. $R^1$ in Formula A expressing polyglycerin fatty acid ester represents alkyl or alkenyl group having 7 to 21 of carbon atoms, preferably 12 to 19 carbon atoms. When carbon atoms in $R^1$ is 6 or less, durable hydrophilicity is low while carbon atoms therein is 22 or more, initial hydrophilicity lowers. $R^2$ and $R^3$ represents H, alkanoyl group having 8 to 22 carbon atoms, preferably 13 to 20 carbon atoms or alkenoyl group. When carbon atoms in $R^2$ or $R^3$ is 7 or less, durable hydrophilicity is low while carbon therein is 23 or more, initial hydrophilicity lowers. And "a", the degree of condensation of glycerin constituting polyglycerin part is 5 to 15, preferably 6 to 10. When degree of condensation "a" is 4 or less, reduction of initial hydrophilicity occurs while degree of condensation "a" is 16 or more, durable hydrophilicity lowers.

Component (B) constituting the fiber treating agent of the present invention is polyoxyalkylene modified silicone expressed by Formula B which is effective for improvement of durable hydrophilicity together with for improvement of initial hydrophilicity in the present invention. To obtain good initial durable hydrophilicity while imparting minimum water solubility to the polyoxyalkylene modified silicone, "b" in Formula B is necessarily in the range of 3 to 15. When "b" is 2 or less, initial hydrophilicity lowers, while "b" is 16 or more, durable hydrophilicity becomes insufficient, because of too much water solubility of polyoxyalkylene modified silicone. As for "c", "d" and "e" in Formula B, their ranges are also restricted due to similar reason as above.

First, as for "c", it is preferable to be in the range of 10 To 120. When "c" is 9 or less, durable hydrophilicity lowers, while "c" is 121 or more, initial hydrophilicity lowers. Also for "d", initial hydrophilicity is low when "d" is 4 or less while durable hydrophilicity becomes insufficient when "d" is 101 or more thus preferable range of "d" is 5 to 100. As for "e", durable hydrophilicity is insufficient when "e" is 4 or less while initial hydrophilicity lowers when "e" is 101 or more thus preferable range of "e" is 5 to 100. Further, to compatibilize initial and durable hydrophilicity, it is necessary for "d +e" to be 105 or less. When carbon atoms in $R^4$ is more than 12, initial hydrophilicity of the fiber having durable hydrophilicity lowers.

Component (C) in the fiber treating agent is alkylimidazolium alkyl sulfate expressed by Formula C mentioned before being a component with excellent anti-static effect. In Formula C, $R^6$ represents alkyl group having 7 to 21, preferably 15 to 19 carbon atoms. When carbon atoms is 6 or less, durable hydrophilicity lowers, while 22 or more anti-staticity lowers. $R^7$ represents methyl or ethyl group both of which can be preferably used in the present invention Component (D) in the fiber treating agent is alkylene oxide adduct of alkanoylamide expressed by Formula D mentioned before having a role to improve durable hydrophilicity. In Formula D, $R^8$ represents alkyl group having 7 to 21, preferably 15 to 19 carbon atoms. When carbon atoms in $R^8$ is 6 or less, durable hydrophilicity lowers, while initial hydrophilicity becomes low when 22 or more. $R^9$ represents alkylene unit having 2 to 4 carbon atoms. When "f" in the formula D is 4 or less, initial hydrophilicity lowers, while durable hydrophilicity lowers when 31 or more, thus "f" is necessarily in the range of 5 to 30. Further, from the viewpoint of initial hydrophilicity, it is preferable for polyether block enclosed by "f" in Formula D to include 50 mol % or more ethylene group.

Component (E) in the fiber treating agent is polyetherester expressed by Formula E mentioned before having an effect to improve durable hydrophilicity. $R^{10}$ in Formula E is a residue of aliphatic hydroxy compound having a hydroxy value of 1 to 6. As for aliphatic hydroxy compound having a hydroxy value of 1 to 6, there can be illustrated as aliphatic alcohols having a hydroxy value of 1 to 6, partial ester of polyhydroxy alcohol obtained by aliphatic alcohol; having a hydroxy value of 2 to 6 with aliphatic monocarboxylic acid having 6 to 18 carbon atoms, hydroxycarboxylic acid having 1 to 5 hydroxy group in the molecule, alkanolamine having 1 to 3 hydroxy group in the molecule, alkyl dialkanolamine and dialkylalkanolamine both having alkyl group of 1 to 18 carbon atoms and alkoxylated polyamine having 1 to 5 hydroxy group in the molecule. $R^{11}$ in the Formula E is polyether-polyester block containing polyether block and polyester block comprising, respectively, alkylene unit having 2 to 4 carbon atoms represented by $R^{13}$ and alkylene unit having 2 to 12, preferably 2 to 8, carbon atoms represented by $R^{14}$ in the Formula F and G. When carbon atom in $R^{14}$ is one, durable hydrophilicity lowers, while initial hydrophilicity lowers when carbon atoms exceeds 12.

In the present invention, either polyether-polyester block copolymer from the following 1) to 4) can be used but copolymer 1) is most preferably used for the present invention:

1) A polyether-polyester block copolymer wherein polyether block and polyester block are bonded in this order, to aliphatic hydroxy compound having a hydroxy value of 1 to 6 (namely, corresponds to the case of m=1 and n=1 in Formula F)
2) A polyether-polyester block copolymer wherein polyester block and polyether block are bonded in this order, to aliphatic hydroxy compound having a hydroxy value of 1 to 6 (namely, corresponds to the case of m=1 and n=1 in Formula G)
3) A polyether-polyester block copolymer wherein polyether block and polyester block each containing more than one unit are alternatively bonded to aliphatic hydroxy compound having a hydroxy value of 1 to 6 (namely corresponds to the case of $m \geqq 2$ and m=n or m=n+1).
4) A polyether-polyester block copolymer wherein polyester block and polyether block each containing more than one unit are alternatively bonded to aliphatic hydroxy compound having a hydroxy value of 1 to 6 (namely corresponds to the case of $n \geqq 2$ and n=m or n=m+1).

Also in the present invention, it is preferable that the sum of $R^3$ representing alkylene unit having 2 to 4 carbon atoms per one hydroxy group of the residue of aliphatic hydroxy compound in the polyether-polyester block copolymer, $g=g_1+g_2+\ldots+g_m$, is 5 to 200 and, at the same time, 40% or more of alkylene unit corresponding to $R^{13}$ being ethylene. Further, it is preferable that the sum of $R^{14}$ contained in total polyester block, $h=h_1+h_2+\ldots+h_n$, is 5 to 200 and $g \geqq h$. Also $R^{12}$ is H, alkanoyl group having 2 to 18 carbon atoms or alkenoyl group having 16 to 22 carbon atoms. Alkanoyl group having 2 to 8 carbon atoms or alkenoyl group having 16 to 22 carbon atoms can be introduced by reacting acylating agent with hydroxy group existing in the end of polyester block in the case where polyetherester used in the present invention is the copolymer 1) mentioned before or in the case where polyester block is bonded to the end of molecule corresponding to $R^{11}$ in 3) or 4) mentioned before. Such an acylated polyetherester block copolymer can also be used in the present invention.

The reason why the fiber treating agent used in the present invention brings about preferable effect, exists in the point that both alkyl imidazolium alkyl sulfate and alkylene oxide adduct of alanoyl amine are used simultaneously. Imidazolin type surface active agent, a cationic surface active agent, has excellent antistatic effect. Although some anionic surface active agents have excellent anti-static effect, durable hydrophilicity could be severely suffered when such anionic surface active agents blended with cationic surface active agents, but such phenomenon has never been observed for imidazolin type surface active agents used in the present invention. Further, durable hydrophilicity of fiber treating agent of the present invention has been greatly improved by using alkylene oxide adduct of alkanoyl amide together with imidazolin type surface active agents.

The fiber having durable hydrophilicity and the fabrics using the fiber of the present invention are those adhered by the fiber treating agent comprising the components described above at the amount of 0.1 to 1% by weight based on the weight of fiber or fabrics. When adhered amount is below 0.1% by weight, not only durable hydrophilicity targeted by the present invention is failed to be acquired, but also caused a troubles such as sticking to cylinder in the process of carding or occurrence of neps due to the lack of anti-staticity. When adhered amount exceeds 1% by weight, improvement in durability remains relatively small and card scum is apt to be taken place. Adhered amount of fiber treating agent is preferably in the range of 0.2 to 0.7% by weight.

The fiber treating agent used for the fiber having durable hydrophilicity of the present invention comprises at least 60% by weight of components (A) to (E) in total based on the weight of fiber treating agent as mentioned before. As to the ratio of each component within the total of (A) to (E), ranges are determined individually by the following reasons.

First, the content of component (A) of polyglycerin fatty acid ester in the total of (A) to (E) is 20 to 40% by weight,preferably 30 to 35% by weight. When content of the polyglycerin fatty acid ester is below 20% by weight, durable hydrophilicity is not obtained, while initial hydrophilicity lowers when exceeding 40% by weight.

The content of component (B) of polyoxyalkylene modified silicone is 5 to 20% by weight, preferably 10 to 15% by weight, based on the total of (A) to (E). When content of the polyoxyalkylene modified silicone is below 5% by weight, initial hydrophilicity can not be obtained while durable hydrophilicity lowers when exceeding 20% by weight.

The content of component (C) of alkyl imidazolium alkyl sulfate is 10 to 25% by weight, preferably 15 to 20% by weight, based on the total of (A) to (E) When content of the alkyl imidazolium alkyl sulfate is below 10% by weight, antistaticity lowers while durable hydrophilicity lowers when exceeding 25% by weight.

The content of component (D) of alkylene oxide adduct of alkanoylamide is 5 to 20% by weight, preferably 10 to 15% by weight, based on the total of (A) to (E). When content of the alkylene oxide adduct of alkanoylamide is below 5% by weight, durable hydrophilicity lowers while initial hydrophilicity lowers when exceeding 20% by weight.

The content of component (E) of polyetherester is 25 to 40% by weight, preferably 30 to 35% by weight, based on the total of (A) to (E). When content of the polyetherester is below 25% by weight, durable hydrophilicity lowers while initial hydrophilicity lowers when exceeding 40% by weight.

In the fiber treating agent used in the present invention, other component can be used by mixing with the fiber treating agent comprising (A) to (E) as far as the expected effects of the present invention are not impaired. In this case, it is necessary that the content of. total of components of (A) to (E) is 60% by weight or more based on the fiber treating agent. As for components which can be used together with fiber treating agent of the present invention, polyhydric alcohol ester such as sorbitan-ester mono-oleate or glycerinester mono-stearate, or polyether obtained by polymerizing alkyleneoxide such as ethylene oxide or propylene oxide can be illustrated; also they can be used in mixture of more than two of them. Also surface active agents acting as emulsifier or smoothing agent can be added.

Process of adhering the fiber treating agent onto thermoplastic fiber is not specifically limited but any known process can be utilized such as contacting with oiling roll in the spinning or stretching process (contact method), dipping in the dipping vat (dipping method), adhering by spraying (spray method), or adhering after fabrication into fiber layer such as web or fabric such as nonwoven fabric by contact, dipping or spray method mentioned above.

Then it will be described that the behavior of fiber treating agent on the surface of fiber in case of dividable conjugate fiber in comparison between fiber treating agent of the present invention and that used traditionally. In the case of radial dividable shape conjugate fiber, for example, usually composed of hydrophobic thermoplastic fibers, hydrophilic fiber treating agent adhered to the fiber surface as fiber finishing agent will be immediately rinsed off in the nonwoven process- using high pressure water. As these fibers themselves are highly hydrophobic, the fibers cannot uniformly get striking energy of water, as fibers keep off from water stream at the initial stage of the nonwoven process by hydro-entanglement. Therefore, nonwoven fabric comprising sufficiently divided ultra fine fibers can not be obtained without increasing stages of hydro-entanglement. On the other hand, radial dividable shape conjugate fiber adhered fiber treating agent of the present invention on the surface of the fiber, can maintain sufficient hydrophilicity and can get striking energy of water uniformly without keeping off from water stream even on repeated nonwoven process by hydro-entanglement, because of very slow loss of the fiber treating agent adhered to the surface of fiber, though fiber itself has very high hydrophobicity, thus being characterized by obtaining nonwoven fabric comprising fully and uniformly divided ultra fine fibers at less stages of hydro-entanglement.

Similarly in case of wet process such as paper making, the fiber having durable hydrophilicity of the present invention can maintain hydrophilicity of fiber and hold good dispersion of fiber in water, because of very slow loss of fiber treating agent into water even in case of fiber using highly hydrophobic resin such as polyolefins.

The fiber having durable hydrophilicity of the present invention can be processed into fabrics using known process. Fabrics as mentioned in the present invention are illustrated for example as woven textile, knitted textile, nonwoven fabric or nonwoven fiber aggregate. Also various mixed fibers made by cotton mixing, mix spinning, mix weaving, doubling and twisting, mixed knitting or union cloth can be formed into fabrics through the above-mentioned processes. Further, fabrics made of fiber having durable hydrophilicity of the present invention, may be used alone or as laminated or integrated state with other nonwoven fabric, knitted or woven fabric, mesh fabric, film or molded article.

The fabrics can be made by any known process. For example, nonwoven fabrics are made using the following processes: short fibers are piled up through dry or wet process into web; then the web is fixed by pressure on heated roll or by super-sonic wave, by partial melting through hot air or by fiber intermingling through high pressure water or needling. Also knitted or woven fabrics are made by knitting or weaving process using spun or continuous fibers. Also the object of the present invention can be achieved by adhering the fiber treating agent mentioned before onto nonwoven fabrics once established by the above mentioned process or by spun bond process, melt blown process or flush spinning process.

Further, among the fiber having durable hydrophilicity of the present invention, conjugate fibers having a cross-section of side-by-side, sheath and core, radial dividable shape or sea and island can be chopped, mixed with water absorbing material such as pulp or water absorbing polymer and heat treated to give a definite shape to water absorbing material. While thermoplastic conjugate fiber in general tend to lower the water absorbability of absorber used such thermoplastic conjugate fiber, when the fiber blending ratio rises higher, it is not the case for the fiber having durable hydrophilicity of the present invention due to maintaining its hydrophilicity.

THE EFFECT OF THE PRESENT INVENTION

The fiber having durable hydrophilicity and the fabrics using the fiber of the present invention has excellent durable hydrophilicity while it does not give unpleasant feeling such as stickiness to users. Thus, for example, in case of using for face or second sheet of hygienic products such as disposable diaper or sanitary napkin, a product is obtained which has continuous absorbing ability of body fluid. after using for a long time and comfortable feeling to skin. Further, the fiber having durable hydrophilicity and the fabrics using the fiber of the present invention can be widely used, besides the above-mentioned face material of hygienic product or shaping material of absorber, wiping cloth for medical or industrial use, absorbing pad, reinforcing fiber for construction structure in civil engineering and construction industry, liquid transporting membrane, aqueduct or water permeable sheet.

EXAMPLES

The present invention will next be described in more detail by way of Examples and Comparative examples, but it should not be construed to be limited thereto. In the following Examples and Comparative examples, evaluation methods and standards are as follows.

(1) Anti-staticity:

A web was made of 40 g of sample fiber using miniature card at the speed of 7 m/min and in condition of 20° C. and 45% relative humidity and the voltage of static electricity generated in the web, was measured and rated as follows:

○: below 100 V

Δ: 100 V or higher and below 500 V

X: 500 V or higher

Electrostatic voltage below 100 V was judged as practically usable level.

(2) Cardability:

In the course of making a web from 40 g of sample fiber using miniature card at the speed of 7 m/min in condition of 30° C. and 80% relative humidity, the miniature card was stopped and the state of fiber on the cylinder was observed and rated as follows as an index of smoothness:

○: no sticking to cylinder

Δ:partial sticking to cylinder

X: almost full sticking to cylinder (3) Appearance of Web:

Appearance of web obtained by the above mentioned method was observed and rated as follows:

○: no nep observed, uniform web with tension

Δ: nep observed locally

X: poor tension and uneven web

XX: local void or break took place

For sample rated as XX, further evaluation has been discontinued.

(4) Hydrophilicity of Original Fabrics:

A web was prepared from 40 g of sample fiber by miniature card at the speed of 7 m/min in conditions of 30° C. and 80% relative humidity. Sampling 5 g of the web, filling it into a basket made from copper wire which has dimension of 3 cm diameter, 8 cm long and 3 g of weight, the basket was dropped from 1 cm height above water surface in water bath of 25° C. temperature. Time by which the basket with sample completely immersed into water was measured. The immersed basket with sample was immediately taken out from water, dehydrated by centrifuge, dried up for 24 hours at room temperature and repeated the test in the same manner described above to measure the immersion time. This measurement was conducted three times in total for the same sample.

(5) Durable Hydrophilicity of Nonwoven Fabric:

A sample of 10 cm×10 cm was cut from nonwoven fabric of 30 g/m$^2$ weight and set onto a commercial disposable diaper which was peeled off of its face material and exposed of its absorbent. A cylinder having inner diameter of 6 cm was further set on the sample. 65 ml of artificial urine was poured into the cylinder and absorbed into the absorbent of disposable diaper through nonwoven sample. After leaving for 3 minutes from pouring of artificial urine, the nonwoven sample was sandwiched between two set of filter paper (Toyo Roshi No. 50) both set consisting of two sheet on which a plate of 10 cm×10 cm together with a weight of 3.5 kg was further set for dehydration. After leaving for 3 minutes, the sample was further open dried for another 5 minutes. The nonwoven sample was put on a filter paper (same as above). Artificial urine conditioned at 23±2° C. in the constant temperature bath was dripped by pipette from the height of 1 cm above the sample drop by drop shifting position up to 20 drops within the range of artificial urine permeation. Number of drops which disappeared from the surface of nonwoven sample within 10 seconds was recorded. This procedure was repeated four times for the same sample to regard as an index of durable hydrophilicity of non-woven fabric.

(6) Hand Touch Feeling:

Hand touch feeling of nonwoven fabric was judged by 10 panel members according to the following standard:

○: Good touch without sticky feeling

X: Feeling sticky or something uncomfortable

Rating was made by the number of panel member who judged as above according to the following ranks:

4: 9 or more who judged as ○

3: 6 to 8 who judged as ○

2: 3 to 5 who judged as ○

1: 2 or less who judged as ○

Examples 1 to 10, Comparative Examples 1 to 8

Following resins were spun singly or combined as shown in the tables into fibers having denier of 2.2 dtex/f with structures of single component fiber (Example 3, Comparative example 5), sheath-core conjugate fiber (Example 1,2, 4,6,8 to 10; Comparative example 1 to 4, 6 to 8), dividable conjugate fiber (Example 5) and side-by-side conjugate fiber (Example 7).

For all conjugate fibers, volume ratio of used two thermoplastic resins were 50:50.

(i) Polypropylene (propylene homopolymer of 16 g/10 min of MFR, designated as "i" in the tables)

(ii) High density polyethylene (ethylene homopolymer of 16 g/10 min of MFR, designated as "ii" in the tables)

(iii) Polyethylene terephthalate (IV value of 0.67, designated as "iii" in the tables)

Using these fibers, fabrics were made according to the following fabricating process. Fiber treating agents having compositions shown in Table 1 to 3 were adhered to the obtained fiber or fabrics at an amount shown in the tables based on the weight of the fiber or fabrics.

Here in the tables, designation indicated in "Fabrics (fabricating process)" column of the tables means that the fabric was made by the following process:

Process(a): Each fiber adhered with various fiber treating agents indicated of their composition in Table 1 to 3 was chopped into 51 mm long, dried, carded into web by miniature carding machine and heat treated by suction dryer (process temperature of 138° C.) resulting in through-air nonwoven fabric having weight of about 30 g/m$^2$.

Process (b): Each fiber adhered with various fiber treating agents shown their composition in Table 1 to 3 was chopped into 51 mm long, dried, carded into web by miniature carding machine and heat treated by embossing roll (ratio of projection area of embossing is 25%) resulting in nonwoven fabric having weight of about 30 g/m$^2$.

Process (c): Spun bonded nonwoven fabric with weight of about 30 g/m$^2$ which was heat treated by embossing roll (ratio of projection area of embossing is 15%) was adhered with various fiber treating agents indicated in Table 1 to 3 and open dried.

Samples of fiber and fabrics thus obtained were evaluated of their performances by the methods mentioned before. However, the sample made by process(c) was not evaluated because antistaticity of fiber, smoothness on carding machine, appearance of web or hydrophilicity of original fabrics (fiber) were considered not to relate to the performance of fiber finishing agent or because such evaluation cannot be made. Also for sample rated of its cardability as XX, fabrics was not made and accordingly test for fabrics was not conducted. These results are shown in Table 1 to 3.

Examples 1 to 6 shown in Table 1 are evaluation of fibers and fabrics (hereafter referred to as "samples") adhered with fiber treating agent comprising components (A) to (E) at the amount of 0.5% by weight. Examples 7 to 10 shown in Table 2 are evaluation of samples adhered with 0.5% by Weight of fiber treating agent comprising components (A) to (E) together with other surface active agent ("Other component") which is preferably used in addition to the fiber treating agent of the present invention at the amount not more than 40% by weight based on the total of the composition.

Comparative examples 1 and 2 are evaluation of samples adhered with 0.05% and 1.5%, by weight respectively, of fiber treating agent comprising components (A) to (E).

Comparative examples 3 to 7 shown in Table 3 are evaluation of samples which do not contain any component of fiber treating agent of the present invention, or which are using fiber treating agent containing either component at the amount far outside the scope of the present invention.

Comparative example 8 in Table 3 is evaluation of sample prepared according to the example disclosed in JP-A-49166/97.

TABLE 1

| | | | Ex 1 | Ex 2 | Ex 3 | Ex 4 | Ex 5 | Ex 6 |
|---|---|---|---|---|---|---|---|---|
| A | | Hexaglycerin monolaurate | 25 | 40 | | | | |
| | | Hexaglycerin monostearate | | | 25 | 35 | | |
| | | Decaglycerin distearate | | | | | 25 | 20 |
| B | | Polyoxyalkylene modified silicone (b = 5, c = 25, d = 15, e = 3, $R_4$ = H, $R_5$ = $CH_3$ in formula B) | | | | | | |
| C | | 1-(2-hydroxyethyl)-1-ethyl-2-pentadecyl-2-imidazolium ethyl sulfate | 20 | 15 | 10 | 15 | 25 | 20 |
| D | | EO (10) adduct of lauric acid amide | 15 | | 5 | | 20 | 5 |
| | | EO (20) adduct of stearic acid amide | | 10 | | 10 | | |
| E | | Polyetherester ($R_{10}$ = residue of ethylene glycol, $R_{12}$ = H, $R_{13}$ = $C_2H_4$ and $C_3H_6$[$C_2H_4$ 60 mol %], $R_{14}$ = $(CH_2)_6$, g = 50, h = 30 in formula E) | 30 | | | | 25 | |
| | | Polyetherester ($R_{10}$ = residue of glycerin, $R_{12}$ = H, $R_{13}$ = $C_2H_6$, $R_{14}$ = $(CH_2)_5$, g = 80, h = 10 in formula E) | | | 40 | 30 | | |
| | | Polyetherester ($R_{10}$ = residue of ethylene glycol, $R_{12}$ = lauroyl, $R_{13}$ = $C_2H_4$ and $C_3H_6$[$C_2H_4$ 60 mol %], $R_{14}$ $(CH_2)_6$, g = 50, h = 30 in formula E) | | 25 | | | | 35 |
| Other component | | Polyether compound (EO 20 · PO 10) | | | | | | |
| | | Sorbitan ester monostearate | | | | | | |
| | | EO (10) adduct of myricyl alcohol | | | | | | |
| | | EO (10) adduct of behenic acid amide | | | | | | |
| | | Stearic acid diethanolamide | | | | | | |
| | | Potassium lauryl phosphate | | | | | | |
| | | Sodium lauryl sulfonate | | | | | | |
| Fiber | | Amount adhered (wt %) | 0.5 | 0.5 | 0.5 | 0.5 | 0.5 | 0.5 |
| | Resin | Fiber structure (cross section) *1 | S/C | S/C | S | S/C | div | S/C |
| | | 1$^{st}$ component (core)/2$^{nd}$ component (sheath) | i/ii | i/ii | i | i/ii | i/ii | i/ii |
| | Cardability | Anti-staticity | ○ | ○ | ○ | ○ | ○ | — |
| | | Smoothness on carding | ○ | ○ | ○ | ○ | ○ | — |
| | | Web appearance | ○ | ○ | ○ | ○ | ○ | — |

TABLE 1-continued

| | | | Ex 1 | Ex 2 | Ex 3 | Ex 4 | Ex 5 | Ex 6 |
|---|---|---|---|---|---|---|---|---|
| Fabrics | | Fabrics (fabricating process) | a | a | b | a | a | c |
| | Hydrophilicity of original fabrics | 1st time | 4.2 | 4.1 | 3.6 | 4.0 | 4.3 | — |
| | | 2nd time | 6.0 | 5.1 | 4.9 | 4.8 | 5.6 | — |
| | | 3rd time | 7.7 | 6.6 | 6.9 | 6.1 | 7.9 | — |
| | Durable hydrophilicity (no. of drop disappeared from 20 drops) | 1st time | 20 | 20 | 20 | 20 | 20 | 20 |
| | | 2nd time | 20 | 20 | 20 | 20 | 20 | 19 |
| | | 3rd time | 20 | 16 | 17 | 20 | 17 | 17 |
| | | 4th time | 15 | 7 | 7 | 12 | 11 | 9 |
| | Hand touch | | 4 | 4 | 4 | 4 | 4 | 4 |

*1 S/C means sheath core type;
S means single component;
"div" means divided type

TABLE 2

| | | Ex 7 | Ex 8 | Ex 9 | Ex 10 | Comp Ex 1 | Comp Ex 2 |
|---|---|---|---|---|---|---|---|
| A | Hexaglycerin monolaurate | | 20 | | | | 30 |
| | Hexaglycerin monostearate | | | 25 | 18 | 20 | |
| | Decaglycerin distearate | 18 | | | | | |
| B | Polyoxyalkylene modified silicone (b = 5, c = 25, d = 15, e = 3, $R_4$ = H, $R_5$ = $CH_3$ in formula B) | 7 | | 10 | 7 | 10 | 10 |
| | Polyoxyalkylene modified silicone (b = 5, c = 25, d = 30, e = 55, $R_4$ = $C_2H_5$, $R_5$ = $CH_3$ in formula B) | | 8 | | | | |
| C | 1-(2-hydroxyethyl)-1-ethyl-2-pentadecyl-2-imidazolium ethyl sulfate | 7 | 8 | 10 | 10 | 25 | 20 |
| D | EO(10) adduct of lauric acid amide | 4 | | | | 20 | 10 |
| | EO(20) adduct of stearic acid amide | | 10 | 5 | 7 | | |
| E | Polyetherester ($R_{10}$ = residue of ethylene glycol, $R_{12}$ = H, $R_{13}$ = $C_2H_4$ and $C_3H_6$[$C_2H_4$ 60 mol %], $R_{14}$ = $(CH_2)_6$, g = 50, h = 30 in formula E) | 24 | 24 | | | 25 | 30 |
| | Polyetherester ($R_{10}$ = residue of glycerin, $R_{12}$ = H, $R_{13}$ = $C_2H_4$, $R_{14}$ = $(CH_2)_5$, g = 80, h = 10 in formula E) | | | 20 | | | |
| | Polyetherester ($R_{10}$ = residue of ethylene glycol, $R_{12}$ = lauroyl, $R_{13}$ = $C_2H_4$ and $C_3H_6$[$C_2H_4$ 60 mol %], $R_{14}$ = $(CH_2)_5$, g = 50, h = 30 in formula E) | | | | 18 | | |
| Other component | Polyether compound (EO 20 · PO 10) | 30 | 10 | 30 | | | |
| | Sorbitan ester monostearate | 10 | 20 | | 40 | | |
| | EO(10) adduct of myricyl alcohol | | | | | | |
| | EO(10) adduct of behenic acid amide | | | | | | |
| | Stearic acid diethanolamide | | | | | | |
| | Potassium lauryl phosphate | | | | | | |
| | Sodium lauryl sulfonate | | | | | | |
| Fiber | | | | | | | |
| | Amount adhered (wt %) | 0.5 | 0.5 | 0.5 | 0.5 | 0.05 | 1.5 |
| Resin | Fiber structure (cross section) *1 | S/S | S/C | S/C | S/C | S/C | S/C |
| | 1st component (core)/2nd component (sheath) | i/ii | iii/ii | i/ii | iii/ii | iii/ii | i/ii |
| Cardability | Anti-staticity | ○ | ○ | ○ | ○ | X | ○ |
| | Smoothness on carding | ○ | ○ | ○ | ○ | Δ | ○ |
| | Web appearance | ○ | ○ | ○ | ○ | X | ○ |
| Fabrics | | | | | | | |
| | Fabrics (fabricating process) | a | a | a | b | a | a |
| Hydrophilicity of original fabrics | 1st time | 4.5 | 4.1 | 3.2 | 3.8 | 62.1 | 3.0 |
| | 2nd time | 5.8 | 5.3 | 4.2 | 4.7 | >180 | 3.4 |
| | 3rd time | 7.3 | 6.8 | 5.7 | 6.0 | — | 4.0 |
| Durable hydrophilicity (no. of drop disappeared from 20 drops) | 1st time | 20 | 20 | 20 | 20 | 9 | 20 |
| | 2nd time | 20 | 20 | 20 | 19 | 3 | 20 |
| | 3rd time | 19 | 18 | 20 | 17 | 0 | 20 |
| | 4th time | 11 | 9 | 16 | 9 | 0 | 20 |
| Hand touch | | 4 | 4 | 4 | 4 | 1 | 2 |

*1 S/C means sheath core type; S/S means side-by-side type

TABLE 3

| | | | Comp Ex 3 | Comp Ex 4 | Comp Ex 5 | Comp Ex 6 | Comp Ex 7 | Comp Ex 8 |
|---|---|---|---|---|---|---|---|---|
| A | | Hexaglycerin monolaurate | 25 | | 50 | 10 | | |
| | | Hexaglycerin monostearate | | | | | 40 | |
| | | Decaglycerin distearate | | | | | | |
| B | | Polyoxyalkylene modified silicone (b = 5, c = 25, d = 15, e = 3, $R_4$ = H, $R_6$ = $CH_2$ in formula B) | | | | | 40 | |
| | | Polyoxyalkylene modified silicone (b = 5, c = 25, d = 30, e = 55, $R_4$ = $C_2H_5$, $R_5$ = $CH_3$ in formula B) | 10 | 25 | | 5 | | |
| C | | 1-(2-hydroxyethyl)-1-ethyl-2-pentadecyl-2-imidazolium ethyl sulfate | 20 | 15 | 10 | 8 | | |
| D | | EO (10) adduct of lauric acid amide | | | 5 | 5 | | |
| | | EO (20) adduct of stearic acid amide | | 5 | | | 10 | |
| E | | Polyetherester ($R_{10}$ = residue of ethylene glycol, $R_{12}$ = H, $R_{13}$ = $C_2H_4$ and $C_3H_8$ [$C_2H_4$ 60 mol %], $R_{14}$ = $(CH_2)_6$, g = 50, h = 30 in formula E) | | | 25 | | | |
| | | Polyetherester ($R_{10}$ = residue of glycerin, $R_{12}$ = H, $R_{13}$ = $C_2H_4$, $R_{14}$ = $(CH_2)_6$, g = 80, h = 10 in formula E) | 30 | | | | 10 | |
| | | Polyetherester ($R_{10}$ = residue of ethylene glycol, $R_{12}$ = lauroyl, $R_{13}$ = $C_2H_4$ and $C_3H_6$ [$C_2H_4$ 60 mol %], $R_{14}$ = $(CH_2)_6$, g = 50, h = 30 in formula E) | | 20 | | 12 | | |
| Other component | | Polyether compound (EO 20 · PO 10) | | 35 | | 30 | | |
| | | Sorbitan ester monostearate | | | | 30 | | |
| | | EO (10) adduct of myricyl alcohol | 15 | | | | | 28 |
| | | EO (10) adduct of behenic acid amide | | | | | | 25 |
| | | Stearic acid diethanolamide | | | | | | 30 |
| | | Potassium lauryl phosphate | | | 10 | | | 15 |
| | | Sodium lauryl sulfonate | | | | | | 2 |
| Fiber | | Amount adhered (wt %) | 0.5 | 0.5 | 0.5 | 0.5 | 0.5 | 0.5 |
| | Resin | Fiber structure (cross section) *1 | S/C | S/C | S | S/C | S/C | S/C |
| | | 1st component (core)/2nd component (sheath) | i/ii | i/ii | i | i/ii | i/ii | i/ii |
| | Cardability | Anti-staticity | ○ | ○ | ○ | ○ | x | ○ |
| | | Smoothness on carding | ○ | ○ | ○ | ○ | Δ | ○ |
| | | Web appearance | ○ | ○ | ○ | ○ | x | ○ |
| Fabrics | | Fabrics (fabricating process) | a | a | a | a | a | a |
| | Hydrophilicity of original fabrics | 1st time | 5.9 | 3.9 | 10.4 | 5.0 | 3.9 | 6.2 |
| | | 2nd time | 6.4 | 8.9 | 16.5 | 6.2 | 6.2 | 7.2 |
| | | 3rd time | 7.7 | 20.8 | 25.9 | 6.9 | 10.1 | 7.9 |
| | Durable hydrophilicity (no. of drop disappeared from 20 drops) | 1st time | 20 | 20 | 20 | 20 | 20 | 20 |
| | | 2nd time | 16 | 12 | 18 | 15 | 16 | 19 |
| | | 3rd time | 10 | 5 | 16 | 7 | 5 | 16 |
| | | 4th time | 3 | 0 | 9 | 0 | 0 | 0 |
| | Hand touch | | 4 | 4 | 4 | 4 | 2 | 4 |

*1 S/C means sheath core type;
S means single component;

What is claimed is:

1. A fiber having durable hydrophilicity adhered with 0.1 to 1.0% by weight of a fiber treating agent based on the weight of fiber, comprising 60% by weight or more of the following components (A), (B), (C), (D) and (E) each contained at the following percentage;

(A) 20 to 40% by weight of polyglycerin fatty acid ester expressed by the following Formula A, based on the total of (A) to (E);

Formula A:

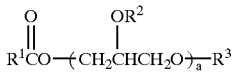

wherein $R^1$ represents alkyl or alkenyl group having 7 to 21 carbon atoms; $R^2$ and $R^3$ each independently represent H, alkanoyl group having 8 to 22 carbon atoms or alkenoyl group; "a" indicates an integer of 5 to 15;

(B) 5 to 20% by weight of polyoxyalkylene modified silicone expressed by the following Formula B, based on the total of (A) to (E);

Formula B:

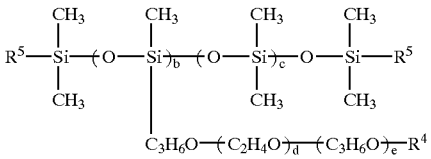

wherein $R^4$ represents H or alkyl group having 1 to 12 carbon atoms; $R^5$ represents $CH_3$ or $C_3H_6O(C_2H_4O)_d(C_3H_6O)_eR_4$; "b" indicates an integer of 3 to 15; "c" indicates an integer of 10 to 120; "d" indicates an integer of 5 to 100 and "e" indicates an integer of 5 to 100 with the proviso that the sum "d+e" is an integer of 105 or smaller;

(C) 10 to 25% by weight of alkyl imidazolium alkyl sulfate expressed by the following Formula C, based on the total of (A) to (E);

Formula C:

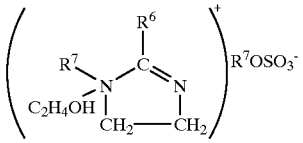

wherein $R^6$ represents alkyl group having 7 to 21 carbon atoms; $R^7$ represents methyl or ethyl group;

(D) 5 to 20% by weight of alkylene oxide adduct of alkanoylamide expressed by the following Formula D, based on the total of (A) to (E);

Formula D:

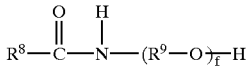

wherein $R^8$ represents alkyl group having 7 to 21 carbon atoms; $R^9$ represents alkylene unit having 2 to 4 carbon atoms; "f" indicates an integer of 5 to 30;

(E) 25, to 40% by weight of polyetherester expressed by the following Formula E, based on the total of (A) to (E); Formula E:

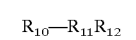

wherein $R^{10}$ represents residue of aliphatic hydroxy compound having hydroxy value of 1 to 6; $R^{11}$ represents polyether-polyester block expressed by Formula F or Formula G; $R^{12}$ represents H, alkanoyl group having 2 to 18 carbon atoms or alkenoyl group having 16 to 22 carbon atoms;

Formula F:

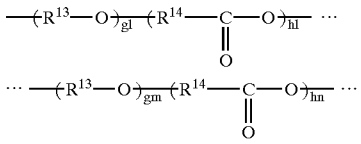

Formula G:

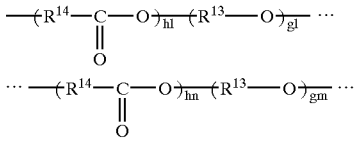

wherein Formula F and Formula G, $R^{13}$ represents alkylene unit having 2 to 4 carbon atoms; $R^{14}$ represents alkylene unit having 2 to 12 carbon atoms; "m" and "n" each indicates an integer of 1 or larger; $g_1$ to $g_m$ each indicates an integer provided that the sum, $g=g_1+g_2+\ldots+g_m$, is 5 to 200; $h_1$ to $h_n$ each indicates an integer provided that the sum, $h=h_1+h_2+h_2+\ldots+h_n$, is 5 to 200 and $g \geqq h$.

2. A fiber having durable hydrophilicity according to claim 1 wherein the fiber is a conjugate fiber comprising at least two kind of thermoplastic resin.

3. A fiber having durable hydrophilicity according to claim 1 wherein at least one of thermoplastic resins composing the fiber is polyolefin resin.

4. A fiber having durable hydrophilicity according to claim 1 wherein at least one of thermoplastic resins composing the fiber is polyester resin.

5. Fabrics comprising a fiber having durable hydrophilicity described in claim 1.

* * * * *